US008465667B2

(12) United States Patent
Davis et al.

(10) Patent No.: US 8,465,667 B2
(45) **Date of Patent: *Jun. 18, 2013**

(54) CHEMICAL ADDITIVES TO INHIBIT THE AIR OXIDATION AND SPONTANEOUS COMBUSTION OF COAL

(75) Inventors: Ronald V. Davis, Geneva, IL (US); Stephen J. Blubaugh, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/438,917

(22) Filed: Apr. 4, 2012

(65) Prior Publication Data

US 2012/0247006 A1 Oct. 4, 2012

Related U.S. Application Data

(63) Continuation-in-part of application No. 13/075,702, filed on Mar. 30, 2011.

(51) Int. Cl.
*C09K 3/22* (2006.01)

(52) U.S. Cl.
USPC ..... 252/88.1; 252/88.2

(58) Field of Classification Search
None
See application file for complete search history.

(56) References Cited

U.S. PATENT DOCUMENTS

| | | | | |
|---|---|---|---|---|
| 5,089,540 | A | 2/1992 | Armbruster et al. | |
| 5,181,957 | A | 1/1993 | Gross et al. | |
| 5,244,473 | A | 9/1993 | Sardessai et al. | |
| 5,441,566 | A | 8/1995 | Vaughan | |
| 5,487,764 | A | 1/1996 | Ford, Jr. | |
| 5,576,056 | A | 11/1996 | Roe | |
| 5,622,561 | A | 4/1997 | Cummins et al. | |
| 5,648,116 | A | 7/1997 | Roe et al. | |
| 5,747,104 | A | 5/1998 | Baebel et al. | |
| 2005/0247907 | A1* | 11/2005 | Sapienza et al. | 252/70 |
| 2009/0025276 | A1 | 1/2009 | Tran | |
| 2009/0189113 | A1 | 7/2009 | Lamperd et al. | |

FOREIGN PATENT DOCUMENTS

| | | |
|---|---|---|
| JP | 56133392 | 10/1981 |
| JP | 2000080356 | 3/2000 |
| JP | 2006328413 | 12/2006 |
| WO | 0212574 A1 | 2/2002 |
| WO | 2009023652 A1 | 2/2009 |
| WO | 2010110805 A1 | 9/2010 |

OTHER PUBLICATIONS

"Challenges of Burning PRB Coal" from internet site www.cba-ssd.com/Applications/knowledgeBase/PRBcoal/ChallengePRB.htm.

Douberly, Edward B., "Fire-protection guidelines for handling and storing PRB coal," Power Magazine, Oct. 2003.

"Standard Classification of Coals by Rank," ASTM International Designation: D388-05, approved Sep. 15, 2005, DOI: 10: 1520/DO388-05.

* cited by examiner

*Primary Examiner* — Necholus Ogden, Jr.

(74) *Attorney, Agent, or Firm* — Benjamin E. Carlsen; Andrew D. Sorensen

(57) ABSTRACT

The invention is directed towards methods and compositions for treating piles of low-rank coal to inhibit its spontaneous combustion. The method involves applying to the low-rank coal a composition containing VAE and crude glycerin. The composition prevents water from evaporating out of the low-rank coal. This prevents the formation within the low-rank coal of hollow openings which are a huge factor in causing its spontaneous combustion. The composition has better performance than its ingredients do alone. In fact it is so effective that certain cumbersome low-rank coal-handling methods, such as FIFO recordkeeping and inventorying, not using pinch points, or only using elbow-free equipment can be disregarded when the composition is used.

14 Claims, 3 Drawing Sheets

CHEMICAL ADDITIVES TO INHIBIT THE AIR OXIDATION AND SPONTANEOUS COMBUSTION OF COAL

CROSS-REFERENCE TO RELATED APPLICATIONS

This application is a continuation in part of co-pending U.S. patent application Ser. No. 13/075,702 filed on Mar. 30, 2011.

STATEMENT REGARDING FEDERALLY SPONSORED RESEARCH OR DEVELOPMENT

Not Applicable.

BACKGROUND OF THE INVENTION

This invention relates to methods and compositions for inhibiting the air oxidation and spontaneous combustion of coal, low-ranked coal, and in particular sub-bituminous coal. Sub-bituminous coal forms within fresh water peat bogs that do not get washed out into the sea and therefore have unique chemical properties. Due to the differences in its formation, sub-bituminous coal has a loose pore structure and retains high levels of water. As a result it is a less efficient fuel than other coals such as anthracite or bituminous coal, and can require as much as double the amount of coal mass to produce the same amount of energy. Sub-bituminous coal also contains large pyrite particles which tend to foul and slag furnace walls before they completely combust. It is not surprising then that historically, sub-bituminous coal has been recognized to be a lower value, less desired feedstock fuel for power generation.

Although all coal dust poses a risk of an airborne explosion, low-ranked and especially sub-bituminous coal poses additional fire risks even when not-in the form of airborne dust. Low-ranked coals are potentially more prone to particle degradation, thereby increasing the open surface area. This facilitates oxidation which can lead to spontaneous combustion. It is believed that, the autogenous grinding tendencies of shipping, handling and transfer of low-ranked coal creates increasingly small particles, increased surface area, and a rich environment for air oxidation to occur resulting in the potential for spontaneous combustion of that coal.

As a result, as mentioned for example in the article *Fire-protection guidelines for handling and storing PRB coal*, by Edward B. Douberly, *Power Magazine* (October 2003), special handling procedures must typically be employed by those low-ranked coal users to decrease the risk of unwanted fires but these procedures make it difficult to simply replace other higher rank coals with low-ranked coal as a substitute fuel in coal based power generation. Low-rank coal users strive to minimize the time allowed to elapse between the mining and ultimate burning of sub-bituminous coal. Furthermore when received at its destination, the coal inventory must be tightly managed, piles groomed to minimize surface area and organized in a FIFO manner such that the age-order of coal inventory forces utilization of the "oldest inventory" first. Also, feeding and handling machinery must be specially designed to minimize attrition and aggressive handling lest coal particle size continue to degrade, allowing finer and finer fragments to turn to dust, accumulate and spontaneously combust. Finally, thermal and atmospheric detectors are employed to constantly analyze piles for the telltale signs of the early stages of spontaneous combustion which must then be rapidly treated or consumed for power production to prevent further degradation.

These degradation processes present an even greater risk in overseas transport of low-rank coal. Most US harbor facilities, let alone foreign ones, lack the special handling equipment needed to safely handle low-rank coal. In addition the coal placed in a ship's hold for extended periods of time creates a situation in which the risk of combustion is intolerably high.

The relatively lower Btu value as well as the increased risk of fire or have, for much of the history of the coal fired power industry, caused sub-bituminous coal to be removed from contention as a useful alternative to higher rank coals.

Recently, however, increasing anthracite and bituminous coal mining costs and rising environmental standards have changed the relative value of sub-bituminous and low-ranked coal. Helping to offset the higher moisture content are sub-bituminous coals' far lower levels of undesirable constituents such as sulfur, mercury or arsenic. Also, subbituminous coal's high Calcium. Oxide and Magnesium Oxide levels cause sub-bituminous coal combustion to produce far less boiler slag. As a result, despite its lower inherent energy and handling difficulties, in many jurisdictions strict environmental laws have made it more suitable to use sub-bituminous coal than other sources of coal, even though they might be of higher fuel content. As a result, sub-bituminous coal tonnage has greatly increased over the past decade and subbituminous coal producers are actively seeking methods for safe shipment in massive ocean-going vessels and acknowledge the urgent need for technology to address the dangers in spontaneous combustion of this coal.

Thus there is a clear utility in novel methods and compositions for inhibiting the spontaneous combustion of coal piles. The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of inhibiting the spontaneous combustion of a pile of low-ranked coal. The method comprises the step of applying to the coal an inhibitor composition. The composition comprises crude glycerin and a VAE copolymer or a PVA copolymer in a ratio of between 90:10 and 10:90.

The low-ranked coal may be left undisturbed for a period of time in which it is probable that but for the presence of the composition, the pile would have spontaneously combusted. The low-ranked coal may be exposed to air or an oxidizing atmosphere for a period of at least 5 days prior to the coal being positioned into a pile. The coal may be handled by an apparatus comprising at least pinch point through which the coal will pass and wherein portions of the coal will accumulate and persist. The coal may be loaded into a ship's hold and remain undisturbed in a pile of at least 30,000 tons for at least 10 days. The coal may be sub-bituminous coal. The composition may inhibit the spontaneous combustion at a rate greater than that of a mixture of VAE mixed with pure glycerin. The pile may be within a ship's hold. The method may exclude the use of a FIFO method in handling the pile. The composition may prevent the oxidation of carbonyl groups within the coal for at least 60 days and but for the composition the carbonyl groups would have undergone at least a 50% increase in the oxidation of the coal's carbonyl groups.

BRIEF DESCRIPTION OF THE DRAWINGS

A detailed description of the invention is hereafter described with specific reference being made to the drawings in which.

DETAILED DESCRIPTION OF THE INVENTION

Figure 1:
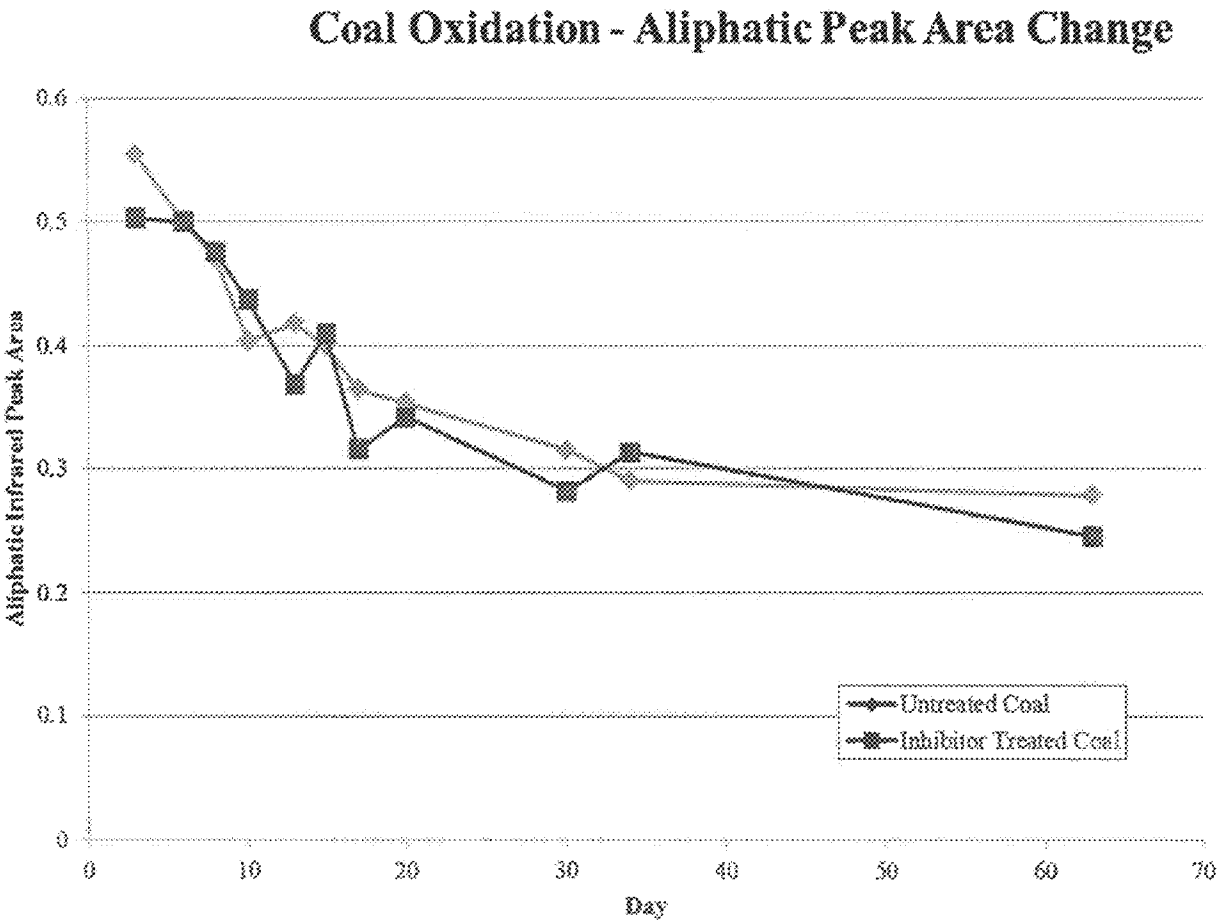
FIG. 1 is a graph illustrating how the invention affects the oxidation of aliphatic portions of coal.

The following definitions are provided to determine how terms used in this application, and in particular how the claims, are to be construed. The organization of the definitions is for convenience only and is not intended to limit any of the definitions to any particular category.

"Arching" means an obstruction in the flow of coal material through a portion of a coal handling process formed out of coal material which has agglomerated into the form of an arch, the arching can be cohesive (formed by particle to particle bonds), interlocking (formed by particles which are large relative to the size of an outlet it passes through and are compacted together by mechanical force such as a collapsing rathole), or both.

"As-shipped" means a rocky composition of matter which has been removed from the ground, substantially all of which has been ground into particles having a volume of no more than 3 inches$^3$, and has not had removed from it the naturally occurring moisture present when the composition was in the ground.

"Crude glycerin" means a by-product derivative from a transesterification reaction involving triglycerides including transesterification reactions involving biodiesel manufacturing processes, in which the by-product comprises glycerin and at least one component selected from the list consisting of fatty acids, esters, salt, methanol, tocopherol, sterol, monoglycerides, di-glycerides, and tri-glycerides.

"Low Ranked Coal" means coal which has a gross calorific value limit of no greater than 9,500 BTU/lb on a moist mineral-included as-shipped basis. Low ranked coal includes sub-bituminous coals, lignite coals, and high volume or highly oxidized bituminous coals.

"Mong" means non glycerol organic material and typically consists of soaps, free fatty acids, and other impurities.

"Particulate material" means a material that has a tendency to form dust particles when handled, processed, or contacted, which includes but is not limited to coal, dirt, wood chips, agricultural products, fruits, fertilizers, ores, mineral ores, fine materials, sand, gravel, soil, fertilizers, or other dust generating material, and any combination thereof.

"Pinch Point" means a piece of equipment or portion thereof present in an industrial process through which there is a general flow of coal material but due to the shape of the piece of equipment or portion thereof, the flow of a portion of the material becomes impinged and that portion remains stationary for a period of time, exemplary industrial processes include but are not limited to coal processing, coal refining, coal handling, coal grinding, coal transporting, coal loading, coal storing, and coal unloading, exemplary types of equipment include but are not limited to chutes, bent or curved pipes, channels, or ducts (elbows), or spaces small enough such that bridges of agglomerated materials collect. Pinch points can cause arching and ratholing of the flowing coal material.

"Powder River Basin" means the geological region (approximately 190 km east-west by 320 km north-south) which is a rich source of naturally occurring Sub-Bituminous Coal located in southeastern Montana and north eastern Wyoming in the vicinity of the cities of Gillette, Wyo., Sheridan Wyo., and Miles City Mont.

"PVA" means polyvinyl acetate polymer.

"Ratholing" means the obstructing of the flow of coal material through a portion of a coal handling process formed out of coal material which has cohesive strength (formed by particle to particle bonds) such that while some of the material flows along a channel within the mass of material, material which is outside of the channel becomes stagnant and does not flow. Ratholes may collapse in the presence of external force such as vibration and when they collapse they may reform into arches.

"Sub-Bituminous Coal" means the compositions of matter bearing this name as defined in ASTM D388-05, it includes naturally occurring coal compositions which have a gross calorific value limit of between 11,500 BTU/lb and 8,300 BTU/lb on a moist, mineral-matter-free basis, it typically has an as-shipped gross calorific value limit of 8400-8800 BTU/lb, it includes but is not limited to Powder River Basin Coal.

"VAE" means vinyl acetate ethylene co-polymer. In at least one embodiment the repeating units of VAE are selected from one of formula I, II, III, IV, and any combination thereof wherein:

Formula (I)

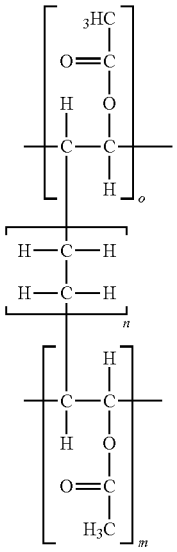

-continued

Formula (II)

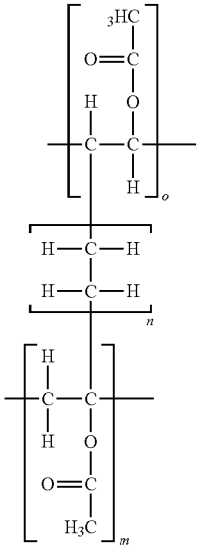

Formula (III)

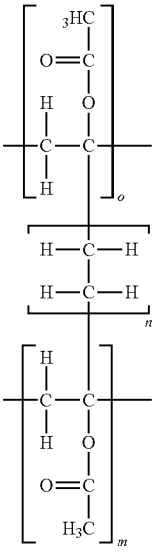

Formula (IV)

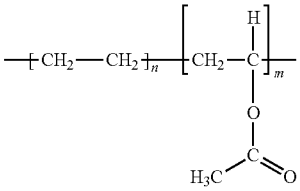

wherein n is the number of cross linking units, m is the number of first chain units, and o is the number of second chain units, either, some, or all of n, m, and o can be 1 or more, although m and o will frequently be 2 or 3 or 4 or more, either or both of the first and second chain units can be left side end (terminal) units of a polymer chain and/or right side end (terminal) units of a polymer chain. VAE can also comprise co-polymers containing additional cross linking units and can comprise additional polymer chains.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Oihmer Encyclopedia of Chemical Technology,* 5th Edition, (2005), (Published by Wiley, John & Sons, Inc.) this definition shall control how the term is to be defined in the claims.

In at least one embodiment the surface of a pile of low-ranked coal is treated with an inhibiting composition to inhibit the spontaneous combustion of the pile. The inhibitor is a composition comprising crude glycerin and VAE copolymer and/or a PVA copolymer. The crude glycerin is derived from a transesterification reaction involving triglycerides.

When handling low-ranked coals people need to be conscious of two distinct fire-based dangers. Coal dust (which can result from all coal not just low-ranked coal) is highly mixed with atmospheric oxygen and can be a cause of a spontaneous explosion. Unique to low-ranked coal is its high propensity to oxidize which can cause fires within the coal piles itself. Low-ranked coal can oxidize and suffer from non-explosion fires within the pile even when substantially all airborne dust has been removed from the presence of the mass of coal.

In at least one embodiment the pile is in the proximity of substantially no dust so it is substantially not at risk of an airborne explosion, but the low ranked-coal is at risk of an oxidation induced fire. In at least one embodiment the presence of dust is excluded. In at least one embodiment the presence of coal which is non-low grade is excluded. In at least one embodiment a substantial risk of an airborne explosion is excluded while the risk of oxidation and oxidation induced combustion is substantial.

Biodiesel is typically made through a chemical process called transesterification in which vegetable oil or animal fats are converted to fatty acid alkyl esters and crude glycerin by-product. Fatty acids and fatty acid alkyl esters can be produced from oils and fats by base-catalyzed transesterification of the oil, direct acid-catalyzed esterification of the oil and conversion of the oil to fatty acids and subsequent esterification to biodiesel.

The majority of fatty acid alkyl esters are produced by the base-catalyzed method. In general, any base may be used as the catalyst used for transesterification of the oil to produce biodiesel, however sodium hydroxide or potassium hydroxide are used in most commercial processes.

Suitable examples of crude glycerin and its manufacture can be found in among other places in U.S. patent application Ser. No. 12/246,975. In the biodiesel manufacturing process, the oils and fats can be filtered and preprocessed to remove water and contaminants. If free fatty acids are present, they can be removed or transformed into biodiesel using special pretreatment technologies, such as acid catalyzed esterification. The pretreated oils and fats can then be mixed with an alcohol and a catalyst (e.g. base). The base used for the reaction is typically sodium hydroxide or potassium hydroxide, being dissolved in the alcohol used (typically ethanol or methanol) to form the corresponding alkoxide, with standard agitation or mixing. It should be appreciated that any suitable base can be used. The alkoxide may then be charged into a closed reaction vessel and the oils and fats are added. The system can then be closed, and held at about 71 degrees C. (160 degrees F.) for a period of about 1 to 8 hours, although some systems recommend that the reactions take place at room temperature.

Once the reactions are complete the oil molecules (e.g. triglycerides) are hydrolyzed and two major products are produced: 1) a crude fatty acid alkyl esters phase (i.e. biodiesel phase) and 2) a crude glycerin phase. Typically, the crude fatty acid alkyl ester phase forms a layer on top of the denser crude glycerin phase. Because the crude glycerin phase is denser than the biodiesel phase, the two can be gravity separated. For example, the crude glycerin phase can be simply drawn off the bottom of a settling vessel. In some cases, a centrifuge may be employed to speed the separation of the two phases.

The crude glycerin phase typically consists of a mixture of glycerin, methyl esters, methanol, mong and inorganic salts and water. Methyl esters are typically present in an amount of about 0.01 to about 5 percent by weight.

In at least one embodiment, methanol can be present in the crude glycerin in an amount greater than about 5 weight percent to about 30 weight percent. In at least one embodiment, the crude glycerin comprises about 30 to about 95 weight percent of glycerin.

VAE is a copolymer in which multiple vinyl acetate polymers contain ethylene side branches which form cross linkages and connect the polymers to each other forming copolymer networks.

In at least one embodiment the composition comprises between 90:10 and 10:90 of VAE copolymer to crude glycerin by mass. In at least one embodiment the composition further comprises water. In at least one embodiment the composition comprises water and the crude glycerin both prevents the freezing of the water and prevents its evaporation thereby reducing the tendency of oxidation to occur.

In at least one embodiment the composition is applied according to any one of the methods or apparatuses of U.S. Pat. No. 5,441,566.

The components of the inhibiting composition may be mixed immediately before addition to the low-grade coal or may be pre-mixed or some components may be pre-mixed and other components may be mixed immediately before addition. The material may be applied in liquid form by a spray boom having one or more spray heads. In at least one embodiment the composition is applied to the material to be coated by at least one of the methods disclosed in U.S. Pat. No. 5,622,561.

In at least one embodiment the composition is applied as the pile is being formed. This can occur for example when material is loaded into a rail car, dump truck, storage facility, silo, or ship's hold. The composition can be applied to the material before and/or as it is poured or dumped into a pile. In at least one embodiment the material passes along a Conveyer belt before it is poured or dumped and the composition is applied to the material as it travels along the belt. In at least one embodiment the composition functions as a tackifier which helps to hold together the material in the form of larger clumps that are less likely to launch as airborne dust.

In at least one embodiment the inhibitor is applied such that one or more of the standard safety protocols can be omitted from the handling of Sub-Bituminous Coal or low-rank coal. For example the inhibitor treated sub-bitumous or low rank coal can be safely processed through a legacy coal handling apparatus having one or more pinch points. Or for example the inhibitor treated low-rank coal can be allowed to remain undisturbed for longer than is allowed for untreated low-ranked coal or it is handled in a non-FIFO manner even though this will result in a pile of low-ranked coal remaining in inventory longer than the safety protocols recommend.

In at least one embodiment the sub-bitumous coal is mined from the Powder River Basin and is handled, stored, and transported according to a legacy coal handling method.

In at least one embodiment the inhibitor treated low-ranked coal is loaded into the hold of a ship where it will sit for at least 11 days undisturbed.

In at least one embodiment the coal is loaded onto the ship after it has sat within a railcar for 1-20 days also undisturbed.

The inventive composition is quite effective and displays a number of unexpected and beneficial results. Prior art combustion inhibiting formulations such as U.S. Pat. No. 5,576,056, Japanese Patents 56133392, 4032149, and 4597922, and Japanese Patent Applications 2000080356, 2006328413, and 1998265757 focus on reducing the formation of dust clouds from coal piles and thereby reduce the spontaneous combustion of those dust clouds. They however do nothing to prevent the degradation/oxidation of coal within the piles. Moreover they do not adequately reduce the potential involuntary combustibility of low-rank or sub-bitumous coal but rather only bitumous coal.

Without limitation to theory and in particular the scope of the claims, it is believed that the crude glycerin forms hydrogen bonds with the coal's hydroxyl groups and carbonyl groups which reduces the reactivity of these groups with oxygen while simultaneously the VAE and/or PVA copolymer serves to seal the surfaces of the treated coal. In addition, the "impurities" within the crude glycerin (such as but not limited to fatty acid methyl esters, partially hydrolyzed fatty acid methyl esters, and inorganic salts) perform better than pure glycerin because they produce a physical barrier along the surface of the coal piles which further bars the oxidation processes of the treated coal.

In addition the composition inhibits combustion caused by the re-filling of the voids within the coal particles. Because moisture does not only flow in one direction voids formed by evaporation sometimes become re-filled by condensing moisture. The process of re-filling the moisture, however, generates heat which accelerates oxidation and thus may in its own right, cause spontaneous combustion. In at least one embodiment the invention retains the moisture and thereby prevents the re-filling of the coal with heat laden moisture.

In at least one embodiment the composition is used on low ranked coal passing through a funnel shaped piece of processing equipment or other pinch point containing equipment. Funnels are characterized as having sloped side walls which slope down to a small opening. Because of the frictional properties of the sloped walls, the innate autogenous/cohesive properties of the low ranked coal, and/or the magnitude of the slope, coal particles adjacent to the walls will have a different flow rate than particles farther from the walls and closer to a region directly over the opening. In at least one embodiment, one of the: frictional properties, slope magnitude, size of the opening, size of the coal material particles, and autogenous/cohesive properties of the coal particles, and any combination thereof is such that but for the presence of the composition the coal particles would form a rathole and only flow through a channel and would oxidize but with the composition such oxidation does not occur.

As previously mentioned in some cases ratholes, arches, and other pinch points can be dislodged or broken up by applying energy such as vibrations. These vibrations however can be dangerous, expensive, and may cause explosions or damage the equipment and as a result they are undesirable. In at least one embodiment the method excludes the application of energy (including but not limited to vibration) to break up a rathole or arch in the piece of equipment that forms a rathole and/or arch for a period of time over which otherwise a user would have applied. In at least one embodiment the application of energy is excluded for a period of time extending from between 1 week to 12 months.

Rathole and arching effects are known to be exacerbated by increasing moisture contents. As previously stated low-ranked coals typically contain higher moisture contents than higher ranked coals and are therefore expected to be more likely to form ratholes, arches or manifest other pinch points than higher ranked coals. In at least one embodiment the low-ranked coal is passed through a piece of equipment in which in the absence of the composition, due to its moisture content the low ranked coal would form an arch, rathole, or pinch point, but a higher ranked coal would not form an arch, rathole, or pinch point, and because of the presence of the composition, the moisture laden low ranked coal does not oxidize or is inhibited from oxidizing.

In at least one embodiment the coal processing equipment contains a crack in which low ranked coal particles collect, become stagnant and may oxidize but in the presence of the composition such oxidation is inhibited and/or does not occur.

In at least one embodiment the low ranked coal passes through the coal processing equipment in the absence of one added item selected from the list consisting of water, wetting agents, foams, micelle encapsulating agents, $CO_2$, $N_2$, and any combination thereof.

EXAMPLES

The foregoing may be better understood by reference to the following examples, which are presented for purposes of illustration and are not intended to limit the scope of the invention.

Figure 2:
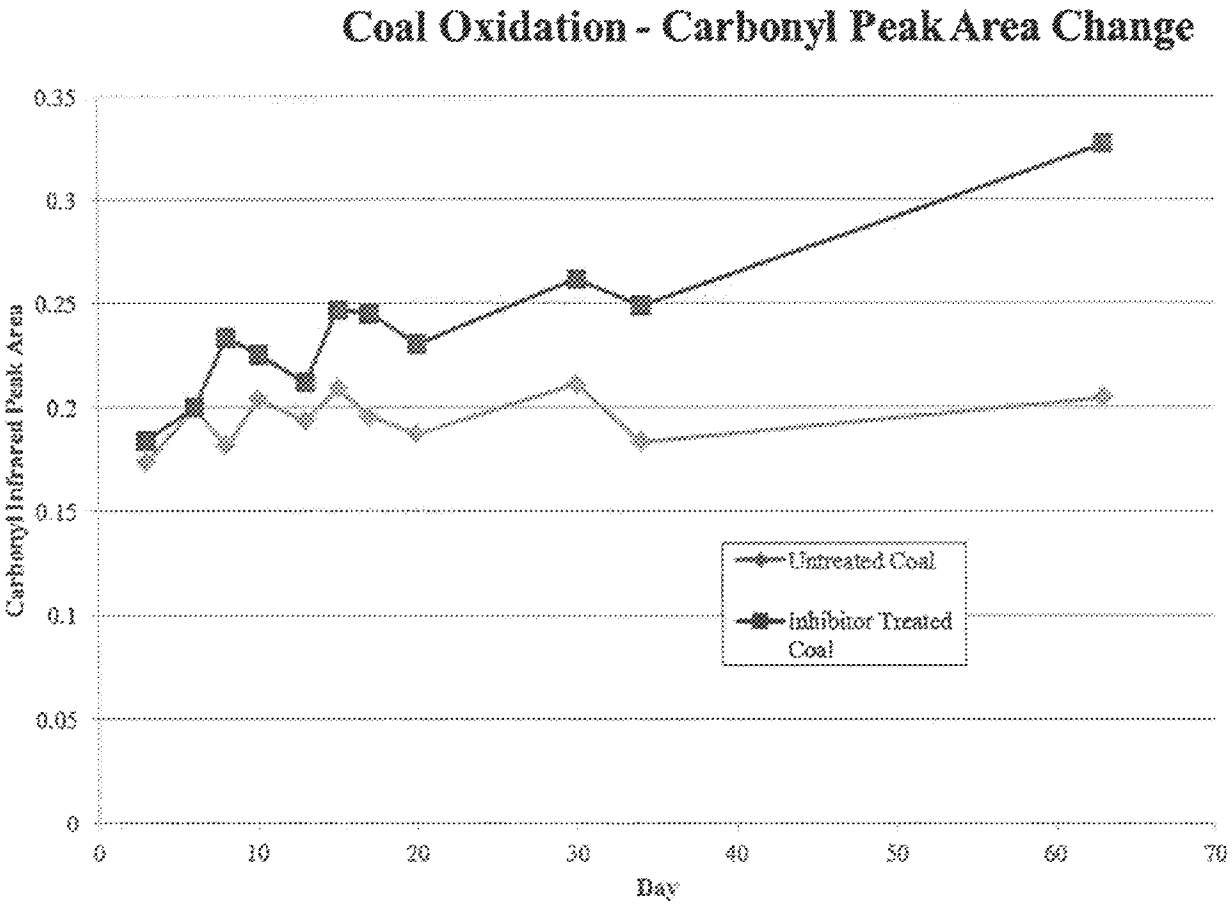
FIG. 2 is a graph illustrating how the invention affects the formation and oxidation of carbonyl containing portions of coal.

Coal oxidation takes place in a series of steps including the oxidation of functional groups of the coal by oxygen, the build-up of oxygen containing oxidation product groups within the coal and the formation of gaseous carbon monoxide and carbon dioxide as the ultimate oxidation products. Using infrared spectroscopy it is possible to monitor the first two processes over time as a sample of coal is oxidized in air. In FIGS. 1 and 2 there are shown samples of treated and untreated sub-bituminous coal which are compared using Fourier Transform Infrared Spectroscopy (FTIR). Both samples were placed in a controlled temperature oven and representative portions collected over time as oxidation of the sub-bituminous coal took place. FTIR spectra of each sub-bituminous coal portion was then obtained and the area of the peaks in the aliphatic hydrocarbon region and the area of the peaks in the carbon-oxygen double bond region (carbonyl) were determined. As shown in FIG. 1, the aliphatic hydrocarbon groups of the untreated and the treated sub-bituminous coal samples are oxidized at approximately the same rate over the course of the test. This is demonstrated by the similarity of the rate of disappearance of these functional groups as measured by the change in the aliphatic peak area of each. As shown in FIG. 2, the treated sub-bituminous coal displays a steady increase in carbonyl species as expected from the oxidation of the aliphatic groups. The untreated sub-bituminous coal, however, displays a relatively unchanged level of carbonyl species over the course of the test. The latter is an indication that the untreated sub-bituminous coal oxidation process is producing gaseous carbon monoxide and carbon dioxide at a much faster rate than in the treated sub-bituminous coal. Clearly, overall oxidation of the treated sub-bituminous coal takes place more slowly than the untreated sub-bituminous coal.

Figure 3:
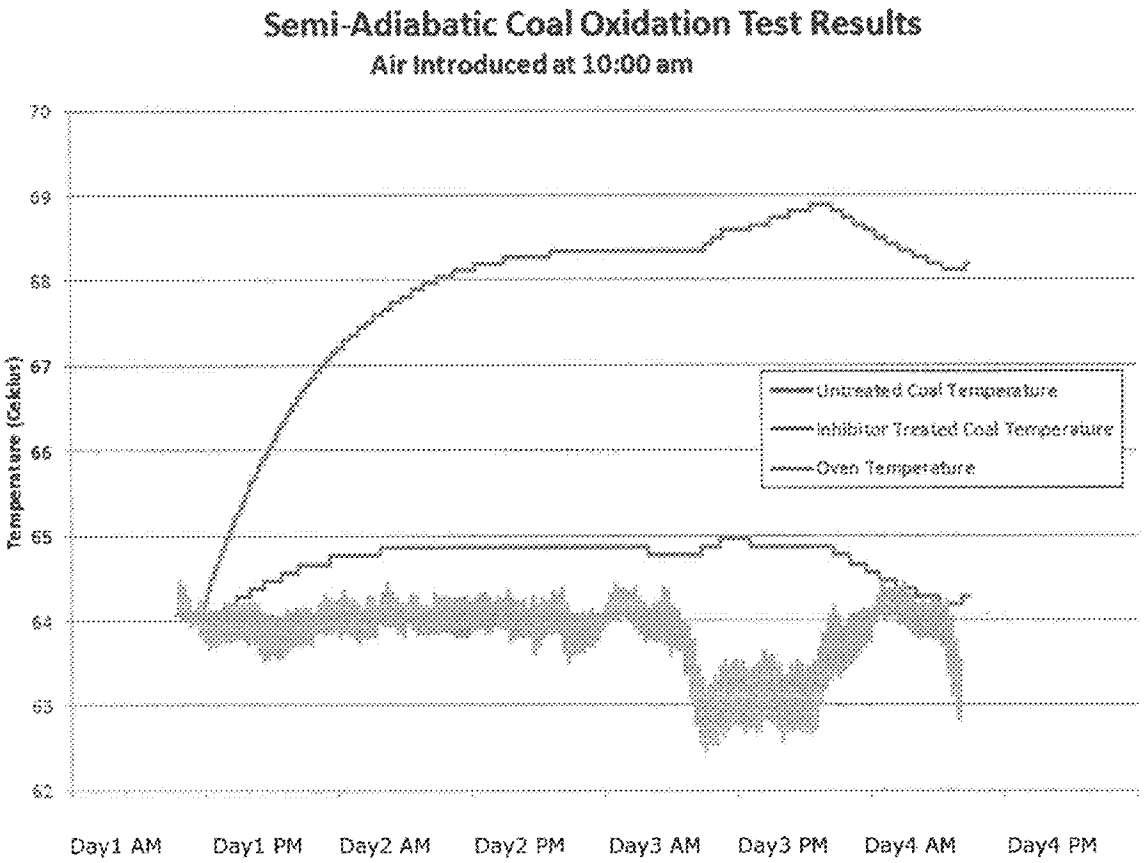
FIG. 3 is a graph illustrating how the invention affects the adiabatic temperature of coal.

Referring now to FIG. 3 there is shown the results of testing the semi-adiabatic oxidation levels of treated and untreated sub-bitumous coal. In this test, selected sub-bitumous coal samples were prepared under an inert atmosphere prior to use and placed in a dewar flask equipped with a thermocouple for measuring the temperature of the coal and with a gas inlet tube to deliver gas directly to the coal and a gas outlet tube to allow gas to escape from the flask. One flask contained treated sub-bituminous coal and another flask contained an untreated portion of the same sub-bituminous coal. The flasks were sealed and placed in a controlled temperature oven under constant nitrogen flow within the flask. When the temperature of the contents of the flasks had reached a steady state the nitrogen flow was stopped and air flow was initiated to both flasks. The same air flow rate from the same air source was applied to each flask. With the application of air to the samples the sub-bituminous coal began to oxidize and the temperature within the flasks began to climb.

The rate of heat build-up within the flasks is related to the rate of oxidation of the material within the flask. Thus, the change in temperature within the flasks provides an indirect measure of the tendency of the contents to resist oxidation (spontaneous combustion) in air. A good spontaneous combustion inhibitor should limit the build-up of heat within the flask compared to untreated coal under comparable conditions. As shown in FIG. 3, the treated sub-bituminous coal yielded a much lower temperature change compared with the untreated coal.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein or mentioned within any mentioned reference, are incorporated by reference in their entirety. Furthermore, the invention encompasses any possible combination of some or all of the various embodiments described herein and/or incorporated herein. In addition the invention encompasses any possible combination that also specifically excludes any one to or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of inhibiting the spontaneous combustion of a mass of low-ranked coal, the method comprising the step of applying to the coal an inhibitor composition, the composition comprising crude glycerin and a VAE copolymer or a PVA copolymer and in a ratio of between 90:10 and 10:90.

2. The method of claim 1 wherein the coal is left undisturbed for a period of time in which it is probable that but for the presence of the composition, the mass would have suffered from an oxidation induced spontaneous combustion.

3. The method of claim 1 wherein the low-ranked coal is exposed to air or an oxidizing atmosphere for a period of at least 5 days prior to the coal being positioned into a pile.

4. The method of claim 1 wherein the coal is handled by an apparatus comprising at least one pinch point through which the coal will pass and wherein portions of the coal will accumulate and persist.

5. The method of claim 1 wherein the coal is loaded into a ship's hold and will remain undisturbed in a pile of at least 30,000 tons for at least 10 days.

6. The method of claim 1 wherein the coal is sub-bituminous coal.

7. The method of claim 1 wherein the composition inhibits the spontaneous combustion at a rate greater than that of a mixture of VAE mixed with pure glycerin.

8. The method of claim 1 wherein the mass is within a ship's hold.

9. The method of claim 1 excluding the use of a FIFO method in handling the mass.

10. The method of claim 1 wherein the composition inhibits the oxidation of carbonyl groups within the coal for at least 60 days and but for the composition the carbonyl groups would have undergone at least a 50% increase in the oxidation of the coal's carbonyl groups.

11. The method of claim 1 wherein the mass is a stagnant mass which has formed in one item selected from the list consisting of a rathole, an arch, a crack in the walls of a piece of coal handling equipment that coal is passing through, and any combination thereof.

12. The method of claim 1 wherein were the mass is a stagnant mass adjacent to a flow of coal mass.

13. The method of claim 1 wherein were the mass is a stagnant mass but were the mass made of high ranked coal instead of low ranked coal the mass would not be stagnant and would have readily flowed through a coal handling process.

14. The method of claim 1 wherein the composition prevents the oxidation of carbonyl groups within the coal for at least 60 days and but for the composition the carbonyl groups would have undergone at least a 50% increase in the oxidation of the coal's carbonyl groups.

* * * * *